US010118059B2

(12) United States Patent
Taniguchi et al.

(10) Patent No.: US 10,118,059 B2
(45) Date of Patent: Nov. 6, 2018

(54) AUTOMATIC FIRE EXTINGUISHING EQUIPMENT

(71) Applicants: NICHIBOU CO., LTD., Tokyo (JP); MITSUI CHEMICALS INDUSTRIAL PRODUCTS LTD., Tokyo (JP)

(72) Inventors: Kenji Taniguchi, Tokyo (JP); Masaya Iwasaki, Otake (JP)

(73) Assignees: NICHIBOU CO., LTD., Tokyo (JP); MITSUI CHEMICALS INDUSTRIAL PRODUCTS LTD., Tokyo (JP)

( * ) Notice: Subject to any disclaimer, the term of this patent is extended or adjusted under 35 U.S.C. 154(b) by 0 days.

(21) Appl. No.: 14/423,630

(22) PCT Filed: Dec. 25, 2013

(86) PCT No.: PCT/JP2013/084622
§ 371 (c)(1),
(2) Date: Feb. 24, 2015

(87) PCT Pub. No.: WO2015/045195
PCT Pub. Date: Apr. 2, 2015

(65) Prior Publication Data

US 2016/0193489 A1 Jul. 7, 2016

(30) Foreign Application Priority Data

Sep. 27, 2013 (JP) ..... 2013-201122

(51) Int. Cl.
*A62C 35/10* (2006.01)
*A62C 3/16* (2006.01)
(Continued)

(52) U.S. Cl.
CPC ..... *A62C 3/16* (2013.01); *A62C 3/07* (2013.01); *A62C 35/10* (2013.01); *A62C 35/023* (2013.01)

(58) Field of Classification Search
CPC .. A62C 3/16; A62C 35/10; A62C 3/07; A62C 35/023; A62C 2/065; A62C 2/08; A62C 2/10
(Continued)

(56) References Cited

U.S. PATENT DOCUMENTS 3,827,502 A * 8/1974 Lockwood ..... A62C 35/10 169/51
5,762,145 A * 6/1998 Bennett ..... A62C 3/07 169/26
5,909,776 A * 6/1999 Stewart ..... A62C 35/10 169/26
6,161,624 A * 12/2000 Bennett ..... A62C 35/10 169/58
6,572,948 B1 * 6/2003 Dykhoff ..... A62C 2/065 169/56
6,612,243 B1 * 9/2003 Italiane ..... A62C 13/22 102/367
(Continued)

FOREIGN PATENT DOCUMENTS

JP 2003-117021 A 4/2003
JP 2004-196926 A 7/2004
(Continued)

OTHER PUBLICATIONS

International Search Report dated Mar. 25, 2014, issued in corresponding Application No. PCT/JP2013/084622 (1 page).

*Primary Examiner* — Darren W Gorman
*Assistant Examiner* — Juan C Barrera
(74) *Attorney, Agent, or Firm* — Westerman, Hattori, Daniels & Adrian, LLP

(57) ABSTRACT

The present invention provides a compact automatic fire extinguishing equipment that can be installed near an object
(Continued)

of fire extinguishing for which there is limited space therearound for a long term in a state of maintenance-free and that can extinguish a fire immediately on the occasion of a fire. The fire extinguishing equipment consists of a fire extinguishing agent 14 and a sealed container 12 filled with the fire extinguishing agent 14. And the fire extinguishing agent 14 is comprised with a compound that is liquid at 25 degrees Celsius (room temperature) at least and that has a boiling point of at least 75 degrees Celsius or less, having fire extinguishing effect. The container 12 is formed with lamination of gas barrier layer 16 and the thermoplastic resin layer 20, and the gas barrier layer 16 consists of ethylene-vinyl-alcohol copolymer resin (ethylene vinyl alcohol copolymer: EVOH).

15 Claims, 8 Drawing Sheets

(51) Int. Cl.
*A62C 3/07* (2006.01)
*A62C 35/02* (2006.01)

(58) Field of Classification Search
USPC ..... 169/58, 34, 54
See application file for complete search history.

(56) References Cited

U.S. PATENT DOCUMENTS 8,067,075 B2 * 11/2011 Nishioka ..... B32B 1/08 428/35.7
2002/0149199 A1 * 10/2002 Tanaka ..... B29C 65/342 285/21.1
2009/0151805 A1 * 6/2009 Martino ..... F16L 11/088 138/125
2013/0277071 A1 * 10/2013 Schaefer ..... A62C 3/16 169/43

FOREIGN PATENT DOCUMENTS

JP 2008-22884 A 2/2008
WO WO 2012062422 * 5/2012 ..... A62C 3/16

* cited by examiner

AUTOMATIC FIRE EXTINGUISHING EQUIPMENT

TECHNICAL FIELD

The present invention relates to an automatic fire extinguishing equipment which forms a jet port made by the heat of the fire and the pressure of the extinguishing agent in a part of the sealed container filled with liquid extinguishing agent, and which has the function that the extinguishing agent is blown out from the jet port to extinguish the fire.

BACKGROUND ART

In recent years, from the point of view of environmental protection such as prevention of air pollution or the carbon dioxide discharge restraint and also from a point of view of utilization of the energy, hybrid vehicles and electric vehicles spread in large quantities. Large-capacity lithium ion batteries having characteristics such as high efficiency, the high output, a high energy density and the light weight etc . . . are carried to hybrid vehicles and electric vehicles.

The lithium ion battery is a large secondary battery having big electric capacity such as several tens of Ah (ampere-hour) and has a problem that in case of charging and driving considerable heat is generated depending on surrounding and becomes high temperature and may possibly cause a fire.

In addition, the lithium ion battery has a problem that when the battery is damaged in a traffic accident, a short circuit happens inside the battery and extreme huge electric current flows and causes a risk of a fire.

In addition, as for hybrid vehicles, they have problems that gasoline catches a fire from the fire occurred by the lithium ion battery as described above. And there is this risk to produce the large secondary fire.

As a method in order to solve this kind of problem, to install an electrical thermo-sensitive sensor in the lithium ion battery as extension of the technique known in the art and to install the outlet of a fire extinguisher operated by this thermo-sensitive sensor in a direction to the lithium ion battery, and a fire occurs, to sense a fire with the thermo-sensitive sensor and to operate a fire extinguisher by an electrical signal sent by the thermo-sensitive sensor and to extinguish the fire of the lithium ion battery are considered.

However, since various kinds of devices are installed in a crowd state inside of the engine room and there are almost no spaces, it is very difficult to install as the above described structure and also it is cost-consuming a lot, and this is a problem.

PRIOR ART DOCUMENTS

Patent Document

Patent Document 1: Japanese Patent Publication No. 2003-117021

DISCLOSURE OF THE INVENTION

Problems to be Solved by the Invention

The problems to be solved by the present invention is to provide a compact automatic fire extinguishing equipment that is easily installed near the object of the fire extinguishing where only limited space available in a state of maintenance-free and having the fire extinguishing ability for a long term; also that can extinguish a fire immediately on the occasion of a fire.

Means for Solving the Problem

The present invention has the most important features of the fire extinguishing equipments as follows:

1) using a compound being liquid at at least 25 degrees Celsius (room temperature) and having at least 75 degrees Celsius of the boiling point as a fire extinguishing agent,
2) filling the above fire extinguishing agent in the sealed container,
3) installing the above container near the object of the fire extinguishing,
4) letting to form a jet port made by the heat of the fire and the pressure of the extinguishing agent in part of the above sealed container and
5) the above container being formed by the laminations of the gas barrier layer and the thermoplastic resin layer.

Advantageous Effect of the Invention

Because the above container is formed by the laminations of the gas barrier layer and the thermoplastic resin layer, the present invention of the automatic fire extinguishing equipment is able to protect from the permeation and disappearance. Therefore this fire extinguishing equipment has the advantages of being in a state of the maintenance-free and being installed keeping its fire extinguishing ability for a long time.

BEST MODE FOR CARRYING OUT THE INVENTION

We materialized a purpose to provide an automatic fire extinguishing equipment which can be installed in a limited space area under the long time maintenance-free conditions and without spoiling the fire extinguishing ability by simple structure.

Embodiment 1

Figure 1:
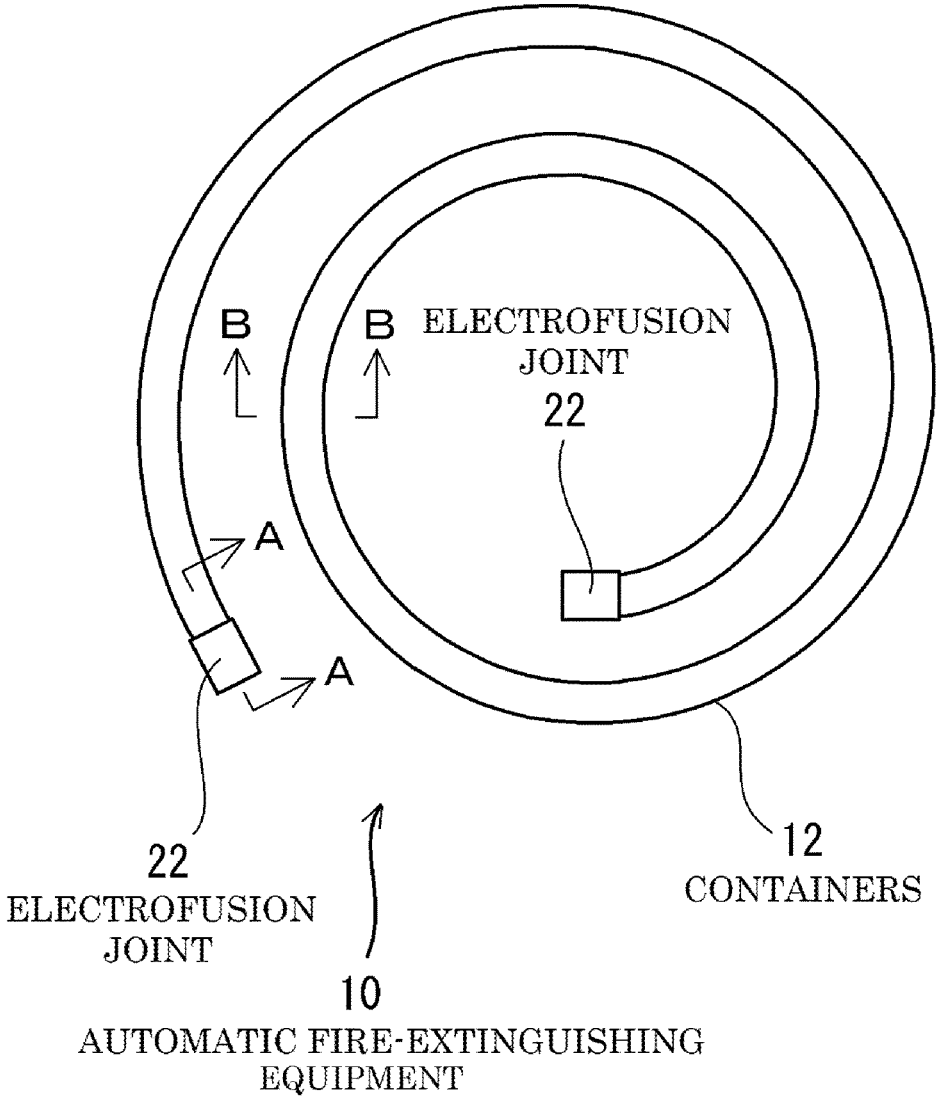
FIG. 1 is a plane view of an embodiment of the automatic fire extinguishing equipment of the present invention.
Figure 2:
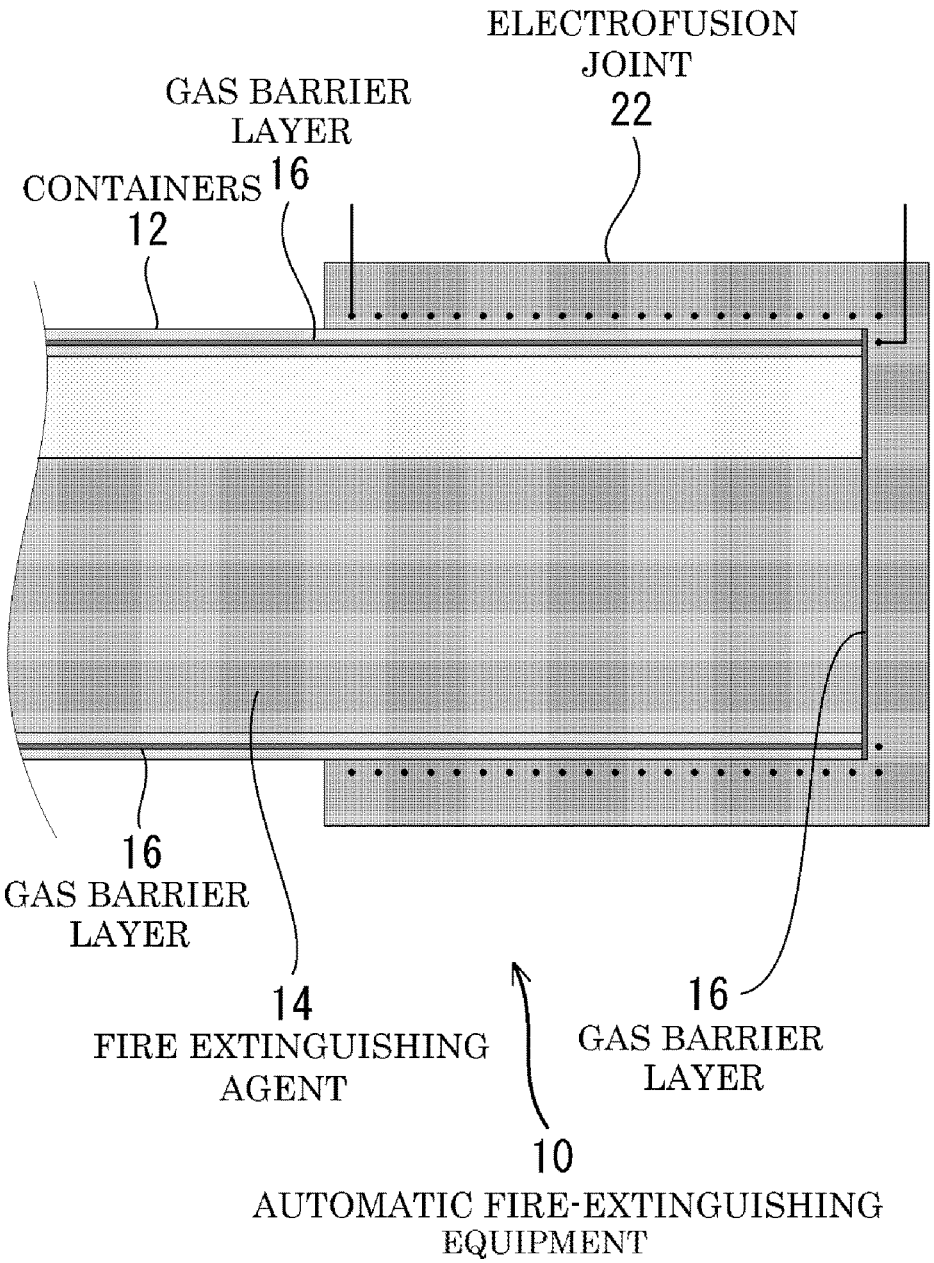
FIG. 2 an A-A cross sectional view of FIG. 1.
Figure 3:
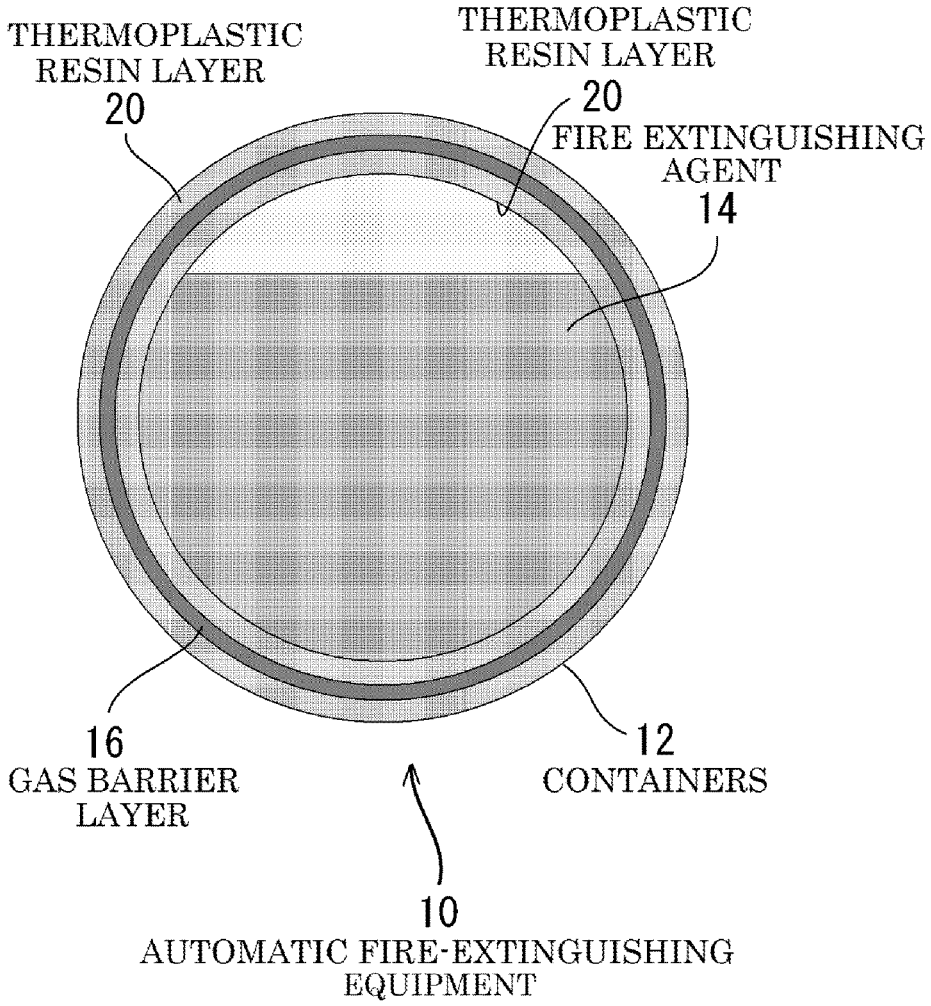
FIG. 3 a B-B cross sectional view of FIG. 1.
Figure 4:
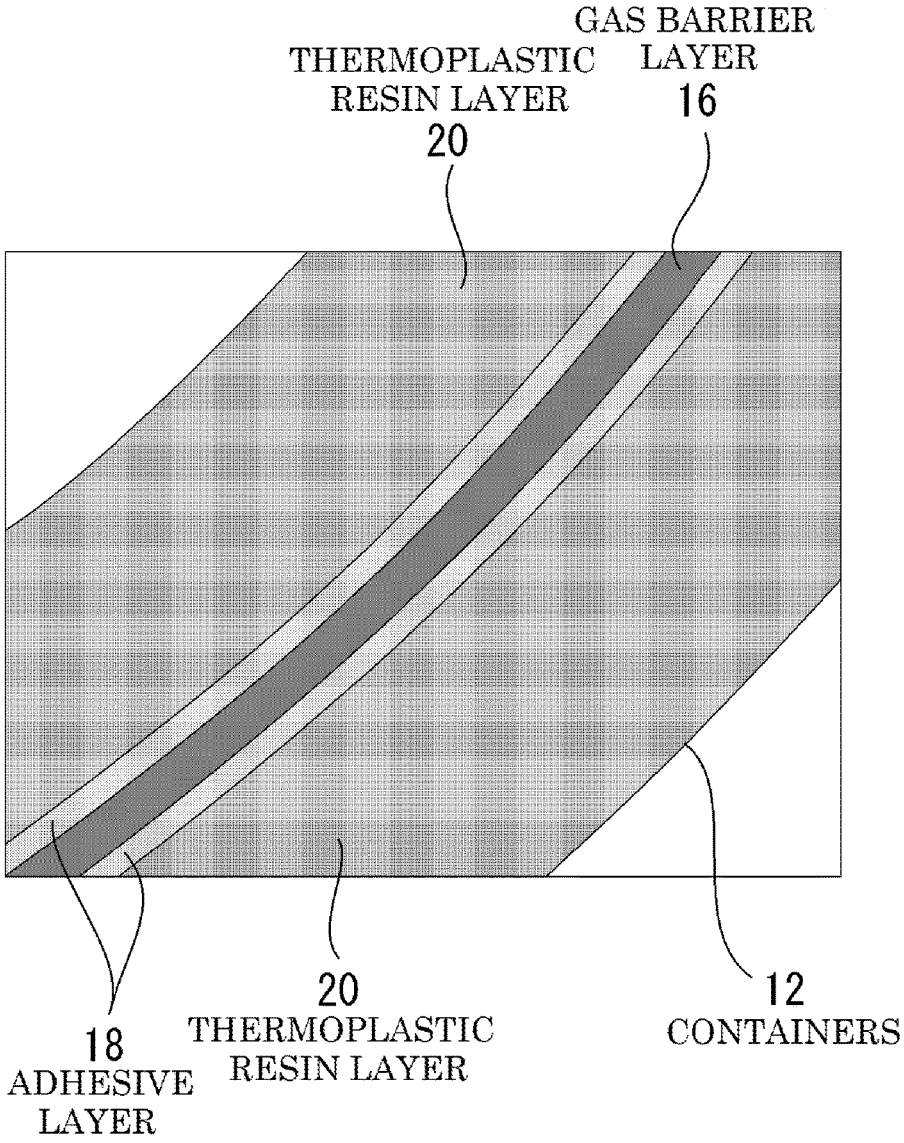
FIG. 4 is a partial enlarged picture of FIG. 3.

As for FIG. 1, this is a plane view of the first embodiment of the automatic fire extinguishing equipment of the present invention. FIG. 2 is an A-A cross sectional view of FIG. 1. FIG. 3 is a B-B cross sectional view of FIG. 1. FIG. 4 is a partial enlarged picture of FIG. 3. In these figures, 10 is an automatic fire extinguishing equipment and this fire extinguishing equipment 10 consists of the container 12 and the fire extinguishing agent 14 which is filled inside of the container 12. The container 12 consists of the gas barrier layer 16 and the thermoplastic resin layer 20 which is adhesive on both sides of the gas barrier layer 16 with the adhesive layer 18.

The container 12 in this embodiment becomes the tube-formed shape shown in FIG. 1. When the container 12 becomes the tube-formed shape, it is desirable to seal off the structure with the electro-fusion joint 22 shown in FIG. 2. This is because when both ends of the container 12 are sealed off by the electro-fusion joint 22, there is no possibilities of the fear of leaks of the extinguishing agent from the container 12.

In addition, in case of only fusion-bonding the end of the container 12, the fusion-bonded part of the end of the container 12 is easily coming off by the heat of the fire and the pressure of the fire extinguishing agent 14. And there is a possibility that the extinguishing agent 14 might leak from the end of the container. As the result of this, it might not be able to extinguish the fire effectively. However, if we make the end of container 12 to be sealed off with the electro-fusion joints 22, such kind of fear would be disappeared and this is an advantageous point.

In addition, the container 12 in this embodiment makes a tube-formed shape on account of the setting to the gap of the rechargeable battery, but the shape of the container 12 should not be limited to be tube-shaped. The shape of the container 12 may be all right with the form of bags, boxes or any other forms.

As for the withstand pressure level of the container 12 at 25-75 degrees Celsius, more than 0.1 MPa are preferable. If the withstand pressure level of the container 12 in 25-75 degrees Celsius is more than 0.1 MPa, the temperature of the rechargeable battery rises by the full electric discharge and the outside temperature, and the automatic fire extinguishing equipment becomes relatively high (MAX 75° C.). But even if the pressure of the inside of the container 12 rises not by a fire, but by the rise of the vapor pressure of the fire extinguishing agent 14 and gaseous expansion, there is no possibility for the container 12 to be damaged. And this is an advantageous point.

As for the SDR (outer diameter÷wall thickness of the pipe) of the container 12, 6-18 is preferable. When SDR (outer diameter÷wall thickness of the pipe) of the container 12 is 6-18, the container 12 is endurable for the pressure of the fire extinguishing agent in ordinary time and in case of a fire the container 12 is immediately fused and damaged. And this is an advantageous point. In addition, as for the outer diameter of the container 12, 4 mm-40 mm is preferable. When the outer diameter of the container 12 is 4 mm-40 mm in consideration of the spaces of the setting place, the fire extinguishing equipment 10 becomes practical size for usage.

The container 12 is formed by the materials which laminated gas barrier layer 16 consisting of materials having high gaseous shielding ability. When the container 12 is formed by a general synthetic resin, the fire extinguishing agent 14 in the container 12 will be permeated and disappeared from the container 12 due to the long time installment of the fire extinguishing equipment and in case of a fire the fire extinguishing equipment may not be able to extinguish the fire. However, when the container 12 is formed by the laminated gas barrier 16 consisting of materials having high gaseous shielding ability, the fire extinguishing agent 14 will be maintained in the container 12 under the long term installment.

As materials having high gaseous shielding ability, ethylene-vinyl alcohol copolymer resin (ethylene-vinyl alcohol copolymer: EVOH) can be used favorably. However, the materials of the gas barrier layer 16 are not limited to EVOH, but also PET (polyethylene terephthalate), PAN (polyacrylonitrile), PVDC (polyvinylidene chloride) etc . . . can be used as the materials because they have high gaseous shielding abilities. In the result of this, these materials can prevent from the permeation and disappearance of the fire extinguishing agent for a long term.

As for the thickness of the gas barrier layer 16, 0.01 mm-1 mm is preferable.

If the thickness of the gas barrier layer 16 is 0.01 mm-1 mm, the permeation of the fire extinguishing agent 14 can be prevented enough. Therefore, fire extinguishing equipment can be installed for a long term in a state of maintenance-free status. If the thickness of the gas barrier layer is more than 1 mm, it would take a long time for the container 12 to be melted down by the heat of the fire and this may cause that the extinguishing of the fire would be late.

Only either aspect of the gas barrier layer 16 is enough for the thermoplastic resin layer 20, but what laminate class of thermoplastic resin 20, 20 on the both sides of class of the gas barriers 16 is desirable as shown in the FIG. 3 and the FIG. 4. When it laminates the thermoplastic resin layer 20, 20 on the both sides of the gas barrier layer 16, the gas barrier layer 16 is protected by the both sides. Therefore, there is an advantage that the permeation and the disappearance of the fire extinguishing agent 14 by the damage of the gas barrier layer 16 can be prevented from.

As the materials of the thermoplastic resin layer 20, polyethylene resin, polypropylene resin and other polyolefin resin can be used. If the materials of the thermoplastic resin layer 20 are formed by polyethylene resin, polypropylene resin and other polyolefin resin, there is an advantage that the container 12 is damaged by the heat of the fire immediately and the fire will be extinguished quickly.

If the materials of the thermoplastic resin layer 20 are polyethylene resin, as for the thickness of the polyethylene resin, 0.5 mm-2.5 mm is preferable. If the thickness is 0.5 mm-2.5 mm, there is an advantage that the container 12 has the strength to endure the pressure of the fire extinguishing agent 14. If the thickness is more than 2.5 mm, it would take a long time for the container 12 to be melted down by the heat of the fire and this may cause that the extinguishing of the fire would be late.

As for the density of the polyethylene resin, 930 kg/m3-960 kg/m3 is preferable. If the density of the polyethylene resin is 930 kg/m3-960 kg/m3, there is an advantage that the domain of the creep performance and the flexibility can be secured.

In addition, as for the materials of the thermoplastic resin layer 20, they are not limited to polyethylene resin, polypropylene resin and other polyolefin resin. If the materials of the thermoplastic resin layer 20 can be maintained the certain strength during the setting inside of the fire extinguishing equipment, and if they can be melted down and if a hole can be formed immediately on the thermoplastic resin layer 20 by the fire, ABS resin (acrylonitrile-butadiene-styrene resin), PB (polybutene) and PS (polystyrene) and so on may be used as the materials.

As the materials of the adhesive layer 18 gluing the gas barrier layer 16 and the thermoplastic resin layer 20 together, polyolefin resin denatured by the functional groups such as maleic anhydride can be used preferably. If the modified polyolefins denatured by the functional groups are used as the adhesive layer 18, there is an advantage that the gas barrier layer 16 and the thermoplastic resin layer 20 can be tightly bonded.

The inside of the container 12 should have a gas moiety of some capacity than it is completely met with the fire extinguishing agent 14. If the fire extinguishing agent is completely met by the inside of the container 12, it would take a long time for the fire extinguishing agent 14 to be heated by the heat of the fire. According to the experience of the fire extinguishing experiments using various prototype products, 50%-90% of the cubic capacity of the container 12 filled with the fire extinguishing agent 14 and 50%-10% of the cubic capacity of the container 12 filled with the gas are desirable.

If 50%-90% of the cubic capacity of the container 12 are occupied with the fire extinguishing agent, and 50%-10% of the cubic capacity of the container 12 are occupied with the gas, the temperature of the fire extinguishing agent 14 becomes easy to rise and the fire extinguishing agent 14 is released immediately by the heating expansion of the gas moiety and there is an advantage that the fire is extinguished immediately.

If inside of the container 12 is not completely filled with the fire extinguishing agent, the gas moiety is formed by the vapor of the fire extinguishing agent 14. But it is all right if inside of the container 12 is filled with the inert gases such as nitrogen, helium gas and may form a gas part. Furthermore, it is also all right if the pressurized gas of the nitrogen gas are filled inside of the container 12. If the pressurized gas of the nitrogen gas is filled inside of the container 12, there is an advantage that the fire extinguishing agent is released immediately and the fire is extinguished immediately in case of a fire.

Figure 5:
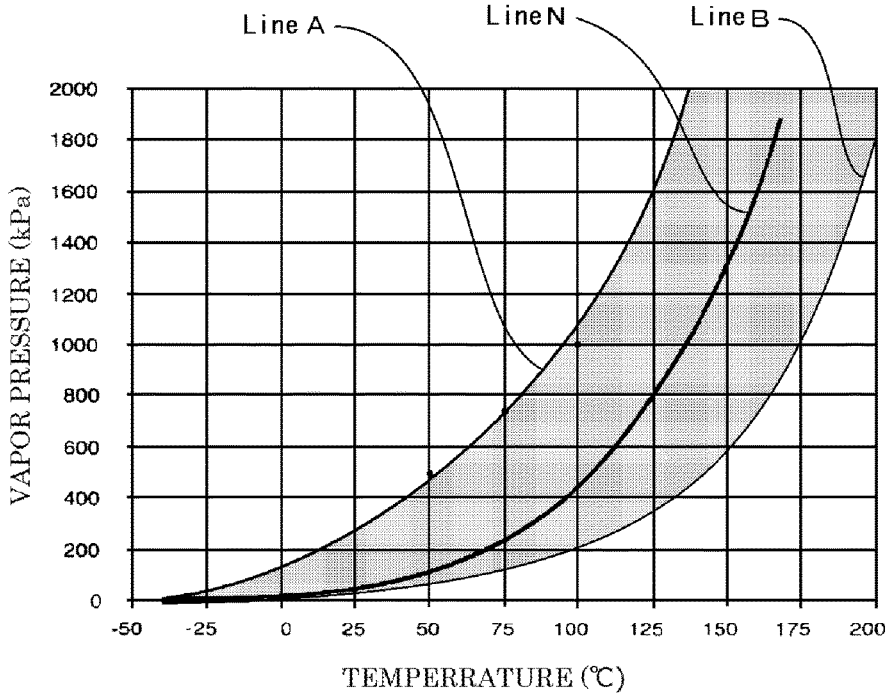
FIG. 5 is a graph indicating the relations between the temperature of the extinguishing agent and vapor pressure.

As for the fire extinguishing agent, for example, the material (ISO registration name: FK5-1-12) shown in a chemical formula of CF3CF2C (O) CF (CF3) 2 is used preferably. But it may be possible to use other materials except the materials mentioned above if the fire extinguishing agent shown as a region (area covered with mesh) surrounded in Line A and Line B of FIG. 5, that is, a compound having fire extinguishing effect, having higher than 0.6 Mpa vapor pressure under 150 degrees Celsius, being liquid at at lease 25 degrees Celsius and having at least 75 degrees Celsius of the boiling point. Incidentally, Line N in the region covered with mesh in FIG. 5 is the above fire extinguishing agent (ISO registration name: FK5-1-12).

Figure 6:
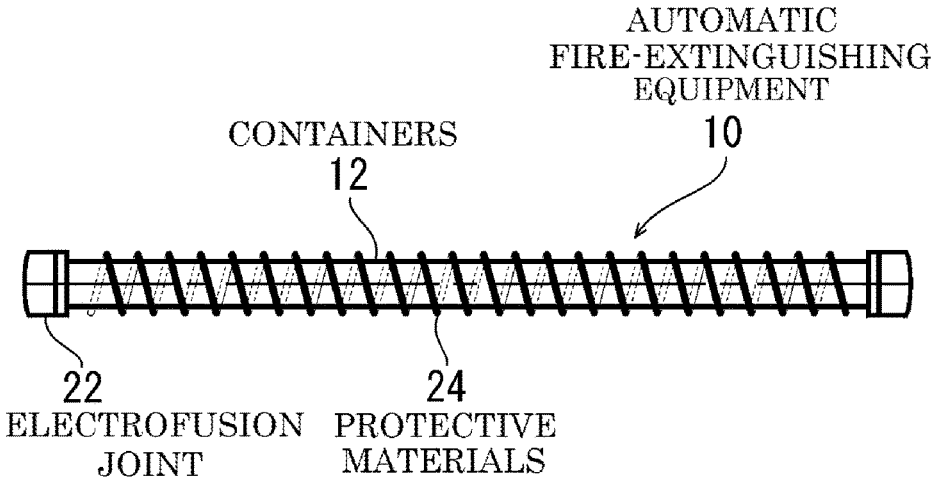
FIG. 6 is an illustration of the automatic fire extinguishing equipment coated by coiled protective materials.

The container 12 may be surrounded by the spiral protective materials 24 consisting of the metal or synthetic resin as shown in the FIG. 6. If the container 12 is surrounded by the spiral protective materials 24 consisting of the metal or synthetic resin, it is possible that the container 12 and the protective material 24 are inserted together in the setting place in a state of being bent. In addition, there is an advantage that when the container is bent, the buckling of the container 12 is prevented. Also if the container 12 is surrounded by the spiral protective materials 24, there is an advantage that a shape (tube shape) of the container 12 is maintained even if the container 12 is softened by the sudden heating at the time of a fire and the shape (tube shape) is hard to be maintained.

For the next step, explanation of the situation for each instance would be made when this fire extinguishing equipment 10 is installed near the object of the fire extinguishing which might produce a fire.

Figure 7:
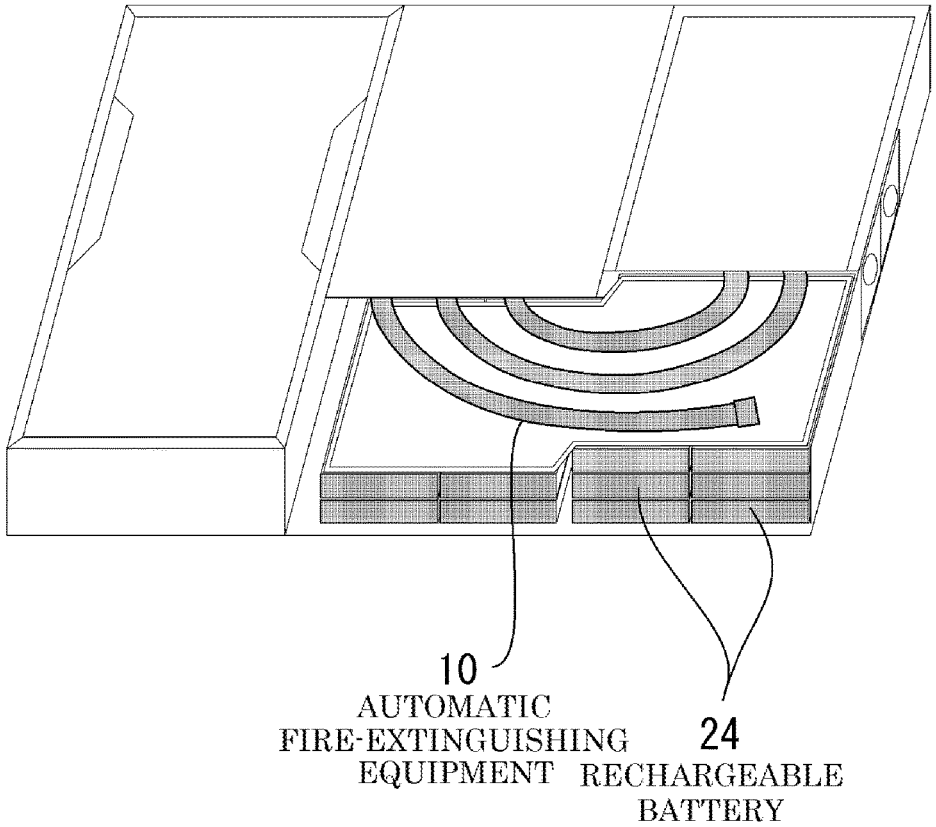
FIG. 7 is an illustration indicating the insertion and installment of the automatic fire extinguishing equipment of the present invention into the gap of the aggregate of the rechargeable battery.
Figure 8:
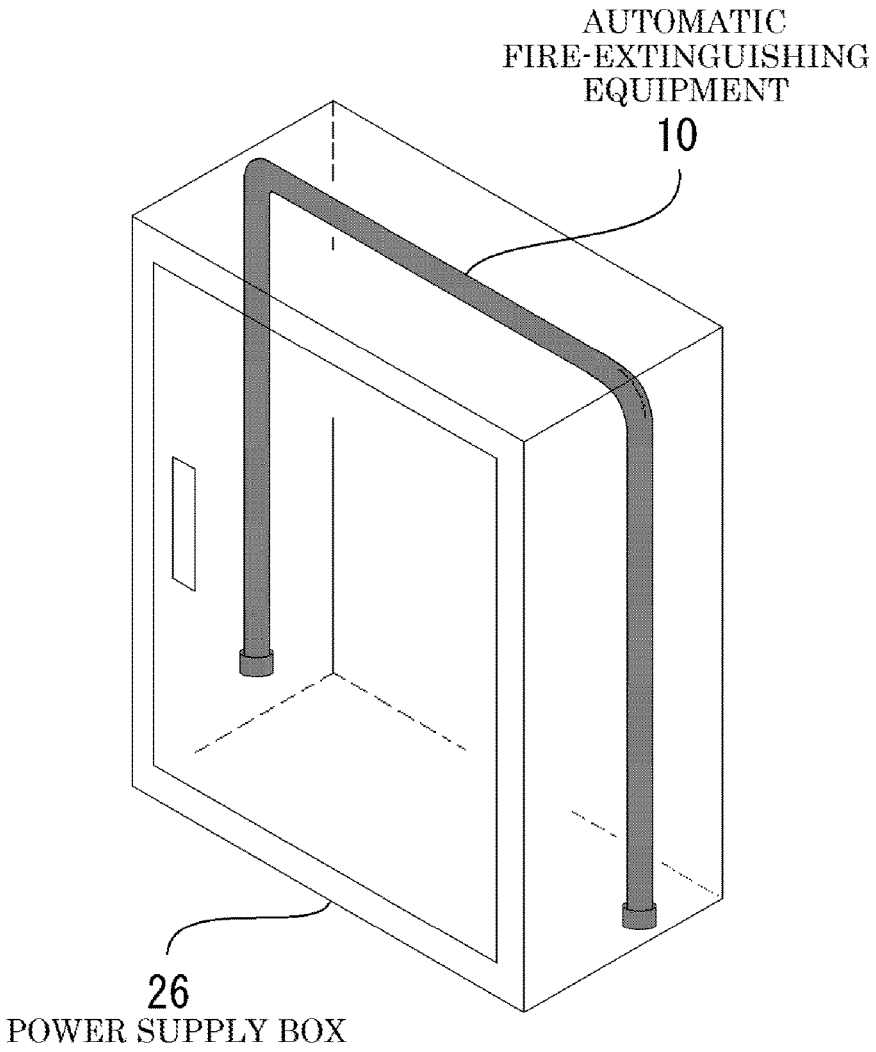
FIG. 8 is an illustration indicating the insertion and installment of the automatic fire extinguishing equipment of the present invention into a power supply box.

At first, this fire extinguishing equipment 10 will be installed near a fire extinguishing object. For example, in case that the aggregate of rechargeable battery 26 installed in a car is the fire extinguishing object, this fire extinguishing equipment 10 is inserted in the gap around the rechargeable battery 26 as indicated in FIG. 7. In addition, in case that the power supply box 28 is the fire extinguishing object, this automatic fire extinguishing equipment is installed inside of the power supply box 28 in a state of being bent as shown in FIG. 8.

In case of the rechargeable battery 26 and the power supply box 28 carried by a car, as there is hardly any fire happening by normal use, the automatic fire extinguishing equipment 10 will be installed around the gap of the rechargeable battery 26 and inside of the power supply box 28 for the long term of the unit of years.

Because the inside of the container 12 of the automatic fire extinguishing equipment 10 is covered by the gas barrier layer 16 from the outside, even if the automatic fire extinguishing equipment 10 has been installed for a long term, the fire extinguishing agent 14 will not be permeated and disappeared from the inside of the container 12. And inside of the container 12, there is sufficient quantity of the fire extinguishing agent which can extinguish a fire is maintained. Therefore, the automatic fire extinguishing equipment is kept in a state of the maintenance-free and it keeps the ability to extinguish a fire for a long term.

However, unluckily a traffic accident damages the rechargeable battery 26, and the short circuit happens inside of the rechargeable battery 26 and a large electric current drifts locally and this may cause a fire. In addition, a severe electric current flows for some kind of causes such as short circuits on the power supply board in the power supply box 28, and a fire may happen in the power supply box 28.

In case that a fire happens in the rechargeable battery 26 and the power supply box 28, the automatic fire extinguishing equipment 10 is heated by the fire and a part of the container 12 in the automatic fire extinguishing equipment 10 is heated by the fire badly and the mechanical strength of the container 12 is partially weakened. And inside of the container 12 will become the high pressure due to the pressure of the gas part which is expanded by the heat of the fire and the vapor pressure of the fire extinguishing agent which is vaporized.

The part of the automatic fire extinguishing equipment, which mechanical strength is weakened by the heat of the fire, will explode by the gaseous pressure and the vapor pressure of the fire extinguishing agent 14 which is vaporized by the heat of the fire. And this explosion makes the hole 30 open on the container 12.

Figure 9:
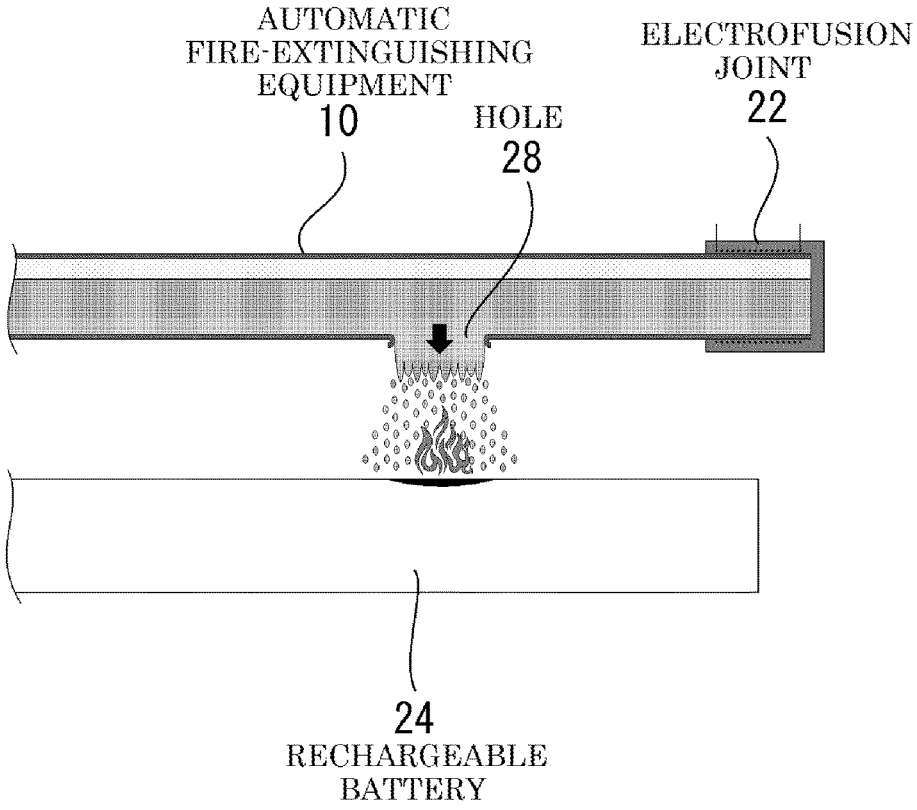
FIG. 9 is an illustration indicating that the automatic fire extinguishing equipment of the present invention makes a hole by exploding by the heat of the fire and that extinguishing agent will be blown out from the hole to extinguish the fire.

And from the hole 30 made by the explosion as shown in the FIG. 9 the fire extinguishing agent 14 will be spouted out for a fire by the pressure of the container 12. And the spouted out fire extinguishing agent will wrap the fire and cut off the air supply to the fire and cool the fire and extinguish the fire by restraining a combustion reaction chemically.

AVAILABILITY IN THE INDUSTRY

The present invention of this automatic fire extinguishing equipment 10 is applicable to not only the rechargeable battery of the car but also the switchboard, the distribution board, the electricity board, the server rack, the lithium battery storage box, the dust collector, the NC lathe, the grinder, various machine tools, the storage of inflammables safekeeping, the chemical experimental device, the fireproof safe, the important documents library, the engine room of the vehicle, the fire of oil storehouse et al.

EXPLANATION OF THE MARK

10: Automatic Fire Extinguishing Equipment
12: Containers
14: Fire Extinguishing Agent
16: Gas Barrier Layer
18: Adhesive Layer
20: Thermoplastic Resin Layer
22: Electro Fusion Joint
24: Protective Materials
26: Echargeable Battery
28: Power Supply Box
30: Hole

The invention claimed is:

1. An automatic fire extinguishing equipment, comprising:

a fire extinguishing agent; and a sealed container filled with the fire extinguishing agent;

wherein the fire extinguishing agent is made of a compound having a fire extinguishing effect, the compound having a boiling point of 75 degrees Celsius or less, the compound being a liquid at 25 degrees Celsius or higher;

wherein the sealed container comprises a gas barrier layer laminated with at least one thermoplastic resin layer;

wherein the gas barrier layer comprises an ethylene—vinyl alcohol copolymer resin;

wherein the thickness of the gas barrier layer is 0.01 mm to 1 mm; and wherein a thickness of the at least one thermoplastic resin layer is 0.5 mm to 2.5 mm.

2. The automatic fire extinguishing equipment described in claim 1, wherein the gas barrier layer is laminated in between two thermoplastic resin layers.

3. The automatic fire extinguishing equipment described in claim 1, wherein the gas barrier layer and the at least one thermoplastic resin layer are laminated via an adhesive layer.

4. The automatic fire extinguishing equipment described in claim 1, wherein the at least one thermoplastic resin layer comprises a polyethylene resin, a polypropylene resin or another polyolefin resin.

5. The automatic fire extinguishing equipment described in claim 4, wherein the at least one thermoplastic resin comprises the polyethylene resin, and wherein the polyethylene resin has a density of 930 $kg/m^3$ to 960 $kg/m^3$.

6. The automatic fire extinguishing equipment described in claim 1, wherein a vapor pressure of the fire extinguishing agent is more than 0.6 MPa at 150 degrees Celsius.

7. The automatic fire extinguishing equipment described in claim 1, wherein the fire extinguishing agent is $CF_3CF_2C(O)CF(CF_3)_2$.

8. The automatic fire extinguishing equipment described in claim 1, wherein 50% to 90% of a capacity within the sealed container is occupied with the fire extinguishing agent, and wherein 10% to 50% of the capacity within the sealed container is occupied with gas.

9. The automatic fire extinguishing equipment described in claim 8, wherein the gas is pressurized.

10. The automatic fire extinguishing equipment described in claim 1, wherein a withstand level at 25 to 75 degrees Celsius of the sealed container is more than 0.1 MPa.

11. The automatic fire extinguishing equipment described in claim 1, wherein the sealed container comprises a pipe, each end of the pipe being closed by an electro-fusion joint.

12. The automatic fire extinguishing equipment described in claim 11, wherein a ratio obtained by dividing an outer diameter of the pipe by a wall thickness of the pipe is 6 to 18.

13. The automatic fire extinguishing equipment described in claim 1, wherein an outer diameter of the sealed container is 4 mm to 40 mm.

14. The automatic fire extinguishing equipment described in claim 1, wherein the sealed container is surrounded by a spiral protective material.

15. The automatic fire extinguishing equipment described in claim 1, wherein the automatic fire extinguishing equipment is configured to extinguish a fire of a switchboard, a distribution board, an electricity board or a rechargeable battery.

* * * * *